US008956155B2

(12) United States Patent
Benedetti et al.

(10) Patent No.: US 8,956,155 B2
(45) Date of Patent: Feb. 17, 2015

(54) THIN FLAME BURNER FOR A FIREPLACE

(75) Inventors: Joseph A. Benedetti, Nashville, TN (US); Kenneth D. Johns, Chapel Hill, TN (US); Michael S. Pennington, Murfreesboro, TN (US); Chad R. Zimmerman, Milton, WA (US)

(73) Assignee: Innovative Hearth Products LLC, Nashville, TN (US)

( * ) Notice: Subject to any disclaimer, the term of this patent is extended or adjusted under 35 U.S.C. 154(b) by 726 days.

(21) Appl. No.: 13/214,394

(22) Filed: Aug. 22, 2011

(65) Prior Publication Data

US 2012/0216793 A1 Aug. 30, 2012

Related U.S. Application Data

(60) Provisional application No. 61/446,939, filed on Feb. 25, 2011.

(51) Int. Cl.

| | |
|---|---|
| ***F23D 14/62*** | (2006.01) |
| ***F24B 1/195*** | (2006.01) |
| ***F24B 1/18*** | (2006.01) |
| ***F24C 3/00*** | (2006.01) |
| ***F24C 3/08*** | (2006.01) |
| ***F23D 14/10*** | (2006.01) |
| ***F23D 14/46*** | (2006.01) |
| ***F23D 14/70*** | (2006.01) |
| ***F24B 1/181*** | (2006.01) |

(52) U.S. Cl.

CPC ..... *F24B 1/195* (2013.01); *F24B 1/1808* (2013.01); *F24C 3/006* (2013.01); *F24C 3/08* (2013.01); *F23D 14/10* (2013.01); *F23D 14/46* (2013.01); *F23D 14/70* (2013.01); *F24B 1/181* (2013.01); *F24B 1/1957* (2013.01); *F23D 2213/00* (2013.01)

USPC ..... 431/354; 126/500; 126/520; 431/125

(58) Field of Classification Search

CPC ..... F23D 14/08; F23D 14/56; F23D 14/58; F23D 14/586

USPC ..... 126/500, 520; 431/125, 354

See application file for complete search history.

(56) References Cited

U.S. PATENT DOCUMENTS

| | | | | |
|---|---|---|---|---|
| 2,588,895 | A * | 3/1952 | Tavener | 431/349 |
| 2,607,405 | A * | 8/1952 | Weinandy | 239/552 |
| 2,884,998 | A * | 5/1959 | Taylor | 239/552 |
| 3,499,720 | A * | 3/1970 | Flynn | 431/349 |

(Continued)

FOREIGN PATENT DOCUMENTS

| | | | | |
|---|---|---|---|---|
| EP | 1998113 | A2 * | 12/2008 | F23D 14/56 |

*Primary Examiner* — Jorge Pereiro

(57) ABSTRACT

A burner assembly for a fireplace, comprising a fuel-metering plate, a fuel-delivery plenum and a dividing plate. The fuel metering plate has tines that form a combed structure in an uppermost portion of the fuel-metering plate, the combed structure extending along a long dimension of the fuel-metering plate. The fuel-delivery plenum has a fuel chamber and the fuel-delivery plenum being coupled to the fuel-metering plate such that the fuel chamber extends along the long dimension of the fuel metering plate. The dividing plate is located between the fuel-metering plate and the fuel-delivery plenum. The dividing plate has a slotted opening that extends along the long dimension of the fuel metering plate, the slotted opening being in fluid communication with individual channels between the tines and with the fuel chamber.

22 Claims, 8 Drawing Sheets

(56) References Cited

U.S. PATENT DOCUMENTS

| | | | | |
|---|---|---|---|---|
| 3,757,767 | A * | 9/1973 | Ito et al. | 126/110 B |
| 4,006,728 | A * | 2/1977 | Nishi et al. | 126/110 R |
| 4,752,213 | A * | 6/1988 | Grochowski et al. | 431/328 |
| 6,746,236 | B2 * | 6/2004 | Kuriyama et al. | 431/354 |
| 6,786,717 | B2 * | 9/2004 | Shimazu et al. | 431/354 |
| 6,910,477 | B1 * | 6/2005 | Barber | 126/91 R |
| 2003/0143507 | A1 * | 7/2003 | Kuriyama et al. | 431/354 |
| 2003/0148241 | A1 * | 8/2003 | Shimazu et al. | 431/354 |
| 2005/0150485 | A1 * | 7/2005 | Barber | 126/85 R |
| 2007/0251467 | A1 * | 11/2007 | Xie et al. | 122/14.31 |
| 2011/0244411 | A1 * | 10/2011 | Rochat et al. | 431/354 |

* cited by examiner

THIN FLAME BURNER FOR A FIREPLACE

CROSS-REFERENCE TO RELATED APPLICATION

This application claims the benefit of U.S. Provisional Application Ser. No. 61/446,939, filed by Joseph A. Benedetti et al. on Feb. 25, 2011, entitled, "IMPROVED LINEAR FIREPLACE WITH BURNER," commonly assigned with this application and incorporated herein by reference.

TECHNICAL FIELD

This application is directed, in general, to fireplaces and, more specifically, to a burner assembly for a fireplace, and to a method of manufacturing the burner.

BACKGROUND

A trend in prefabricated fireplace design has been a minimalist approach to the exterior of the fireplace, with a minimum of exposed metal outside the interior viewing area. Consequently, there is more emphasis on what is inside of the fireplace to create visual interest. Thus, flame aesthetics have become a more significant feature. It is important, however, for the flame burner assembly providing this feature to have a low production and operating costs, and have long durability.

SUMMARY

One embodiment of the present disclosure is a burner assembly for a fireplace. The assembly comprises a fuel-metering plate, a fuel-delivery plenum and a dividing plate. The fuel metering plate has tines that form a combed structure in an uppermost portion of the fuel-metering plate, the combed structure extending along a long dimension of the fuel-metering plate. The fuel-delivery plenum has a fuel chamber and the fuel-delivery plenum is coupled to the fuel-metering plate such that the fuel chamber extends along the long dimension of the fuel metering plate. The dividing plate is located between the fuel-metering plate and the fuel-delivery plenum. The dividing plate has a slotted opening that extends along the long dimension of the fuel metering plate, the slotted opening being in fluid communication with individual channels between the tines and with the fuel chamber.

Another embodiment is a fireplace, comprising walls defining an enclosed space and at least one opening, and the above-described burner assembly located inside of the enclosed space. The burner assembly is positioned such that a long dimension of a burner head of the burner assembly is viewable through the opening from outside of the fireplace.

Another embodiment of the present disclosure is a method of manufacturing a burner assembly. The method comprises providing the above-described fuel-metering plate, positioning the above-described dividing plate adjacent to the fuel-metering plate and positioning the above-described fuel-delivery plenum adjacent to the dividing plate.

BRIEF DESCRIPTION OF THE DRAWINGS

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

Embodiments of the present disclosure provide a burner assembly that enables precise control of the depth, width and height of a flame through the use of a series of adjacent plates that control the movement of fuel, primary air and secondary air through the burner's outlet. In some cases, by vertically directing the flame through the outlet, a stable and controlled visually pleasing flame with high visibility can be generated while at the same time minimizing the fuel expended to produce the flame.

The disclosed burner assembly structure differs substantially from some conventional fireplace burner assemblies that have, e.g., simple round holes in a surface forming the burner top with the standard approach being more or larger holes when more flame is desired. Such conventional designs are not readily able to influence flame structure with the fuel and primary air flow or with secondary air flow. Moreover, such conventional designs often increase the flame's height at the expense of also increasing the flame's depth, which may not be visible and which may require more fuel to burn.

Figure 1:
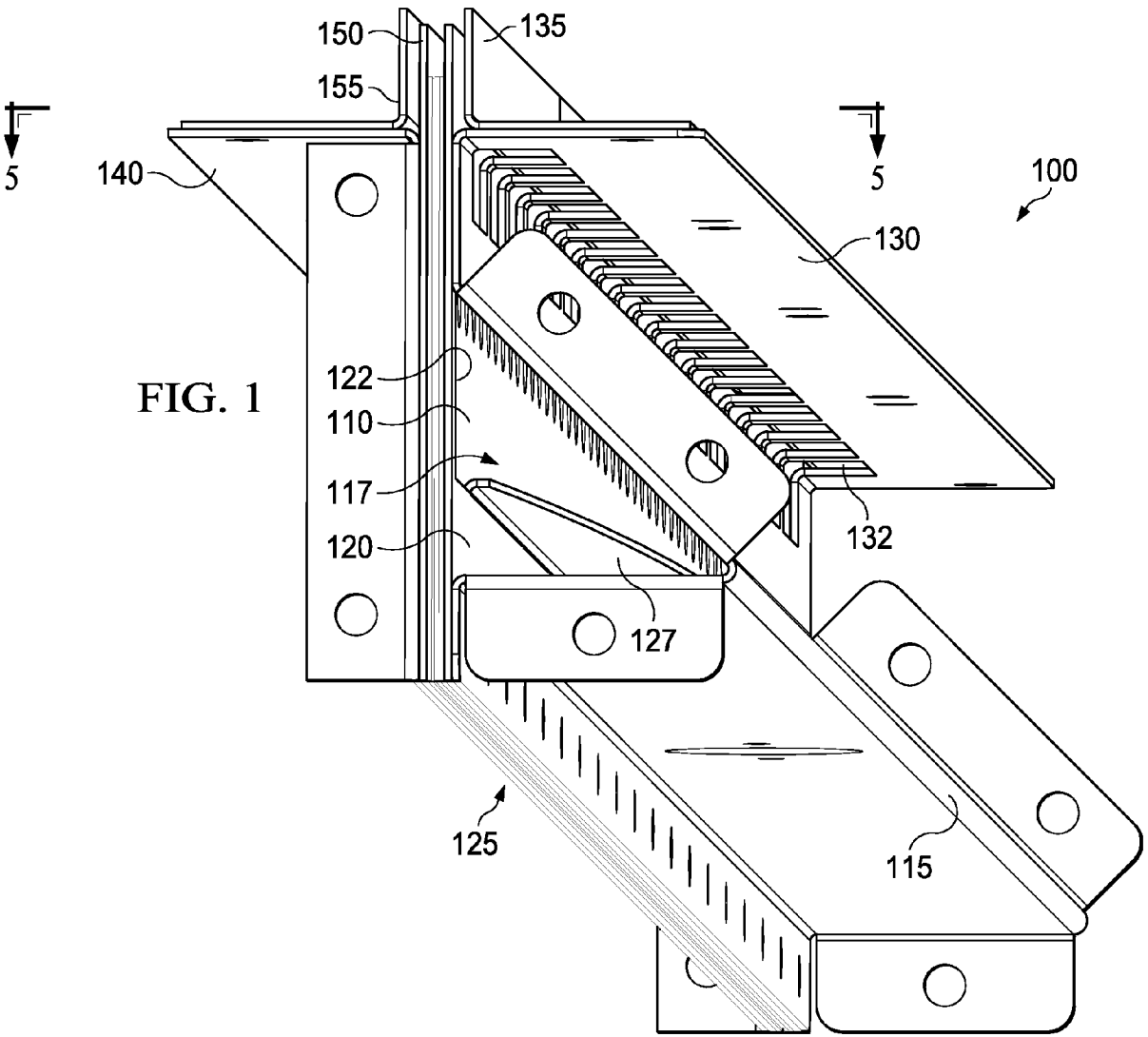
FIG. 1 presents a three-dimensional view of an example burner assembly of the disclosure.
Figure 2:
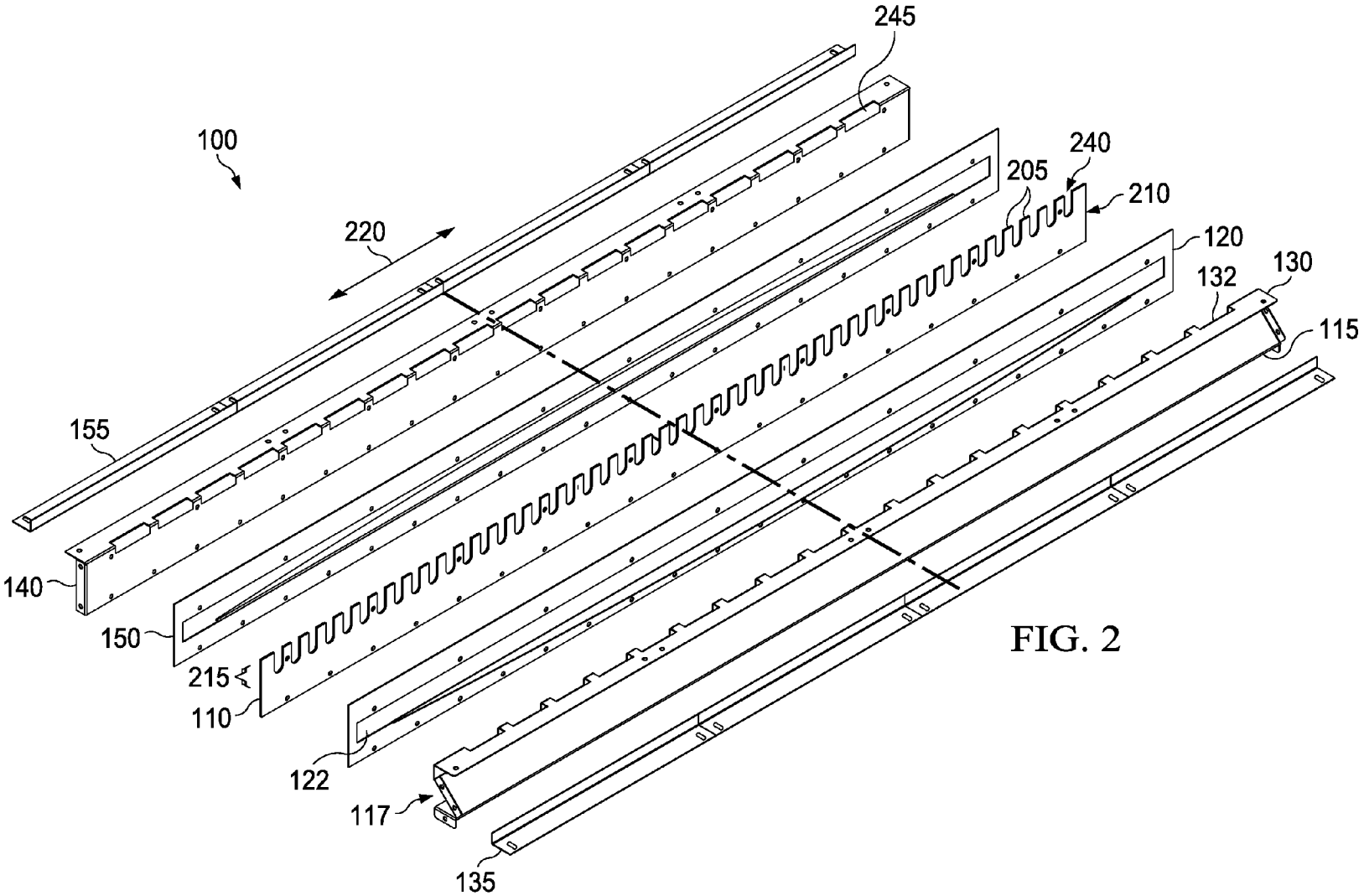
FIG. 2 presents a three-dimensional exploded view of components of an example burner assembly of the disclosure, such as the example burner assembly depicted in FIG. 1.

One embodiment of the present disclosure is a burner assembly for a fireplace. FIG. 1 presents a three-dimensional view of an example burner assembly 100 of the disclosure. FIG. 2 presents a three-dimensional exploded view of components of an example burner assembly of the disclosure, such as the example burner assembly depicted in FIG. 1.

As illustrated in FIG. 1, the burner assembly 100 includes a fuel-metering plate 110, a fuel-delivery plenum 115 having a fuel chamber 117, and a dividing plate 120 located between the fuel-metering plate 110 and the fuel-delivery plenum 115. Some embodiments of fuel chamber 117 can be configured as a mixing chamber for the fuel (e.g., natural gas) and primary air prior to the mixture's delivery to individual channels 240 (FIG. 2). Other embodiments of fuel chamber 117 can additionally, or alternatively, be configured to stabilize and equalize the pressure and velocity of the fuel-primary air mixture delivered to the individual channels 240.

As further illustrated in FIG. 2, the fuel-metering plate 110 has tines 205 that form a combed structure 210 in an uppermost portion 215 of the plate 110. The combed structure 210 extends along a long dimension 220 of the plate 110.

As also illustrated in FIGS. 1 and 2, the fuel-delivery plenum 115 is coupled to the fuel-metering plate 110 such that the fuel chamber 117 extends along the long dimension 220 of the fuel metering plate 110.

As further illustrated in FIGS. 1 and 2, the dividing plate 120 has a slotted opening 122 that, in the assembly 100, extends along the long dimension 220 of the fuel metering plate 110. The slotted opening 122 is in fluid communication with individual channels 240 between the tines 205 and also in fluid communication with the fuel chamber 117. By adjusting the location of slotted opening 122 between the fuel-metering plate 110 and the fuel-delivery plenum 115 the rate of fuel flow can be adjusted by increasing or decreasing the volume of fluid communication from the chamber 117 to the channels 240.

As depicted in the example embodiment in FIG. 1, the fuel-metering plate 110, and the dividing plate 120, and in some cases also fuel-delivery plenum 115, can be horizontally stacked, e.g., to form a stacked assembly 125, relative to the assembly's 100 location in a fireplace. For example in some embodiments the dividing plate 120 and the fuel-metering plate 110 are one pair of a plurality of pairs of dividing plates 120 and metering plates 10 arranged in a stacked assembly 125. In some cases the stacked assembly 125 can form a linear burner assembly 100, where the long dimension 220 of the metering plate 110 is straight. In other embodiments, however, the burner assembly 100 could have vertically stacked assemblies 125 or other-angled stacked assemblies 125 of the plates 110, 112 or plenum 120, or other optional components of the assembly 100. In other embodiments, however, the stacked assembly 125 of the fuel-metering plate 110 and the dividing plate 120 can include one or more bends so that the long dimension 220 forms a curved or other non-linear structure.

Figure 3:
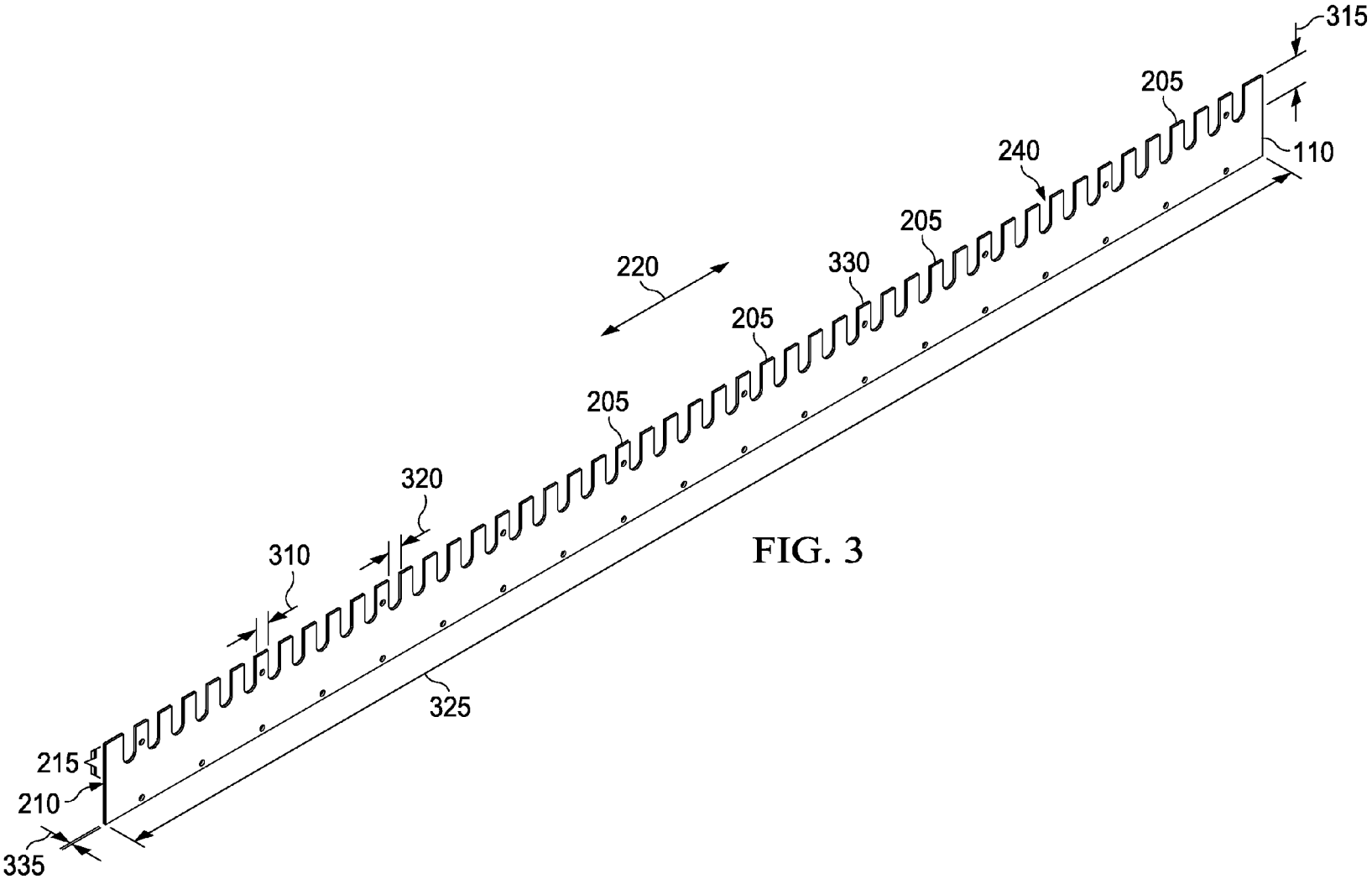
FIG. 3 presents a three-dimensional view of a metering plate of the burner assembly, such as the example burner assembly depicted in FIGS. 1 and 2.

FIG. 3 presents a three-dimensional view of a metering plate 110 of the burner assembly of the disclosure, such as the example burner assembly 100 depicted in FIGS. 1 and 2.

In some embodiments, all of the tines 205 have a same width 310, a same height 315, and, adjacent tines are equally spaced apart by a same distance 320. For instance, in some embodiments the width 310 of each tine 205 is a same value in a range of about 0.25 to 1 inches, the height 315 is a same value in a range of about 1 to 2 inches the spacing distance 320 is a same value in a range of about 0.25 to 1 inches and a length 325 of the metering plate is a value in a range of about 42 to 54 inches. Configuring the metering plate 110 in this fashion can facilitate producing a flame of uniform appearance over the entire length 325 of the long dimension 220. For instance, to produce a flame of uniform height, in some embodiments, the tops 330 of the tines 205 are all in a same horizontal plane.

However in other embodiments, such as when it is desirable to produce a flame of non-uniform appearance, one or all of the width 310 or height 315, can be varied from one tine 205 to another tine 205, and/or, the spacing distance 320 between tines 205 can be varied.

In some embodiments, a thickness 335 of the fuel-metering plate 110, including the thickness 335 of the tines 205, is a value in a range from 0.01 inches to 0.04 inches, and in some cases from 0.01 to 0.06 inches. For example in some embodiments the fuel-metering plate 110, and in some cases, the fuel-delivery plenum 115 and the dividing plate 120, are cut from 28 or 20 gauge steel sheets. In some embodiments, such as when the fuel-metering plate 110, fuel-delivery plenum 115, and the dividing plate 120 are bent, as a stack 125 or individually, it is desirable for these components to have smaller thicknesses, e.g., such as provided by 28 to 33 gauge steel sheets. In other cases, when a more rigid linear structure is desired, e.g., 18 to 20 gauge steel may be used in forming these components.

Figure 4:
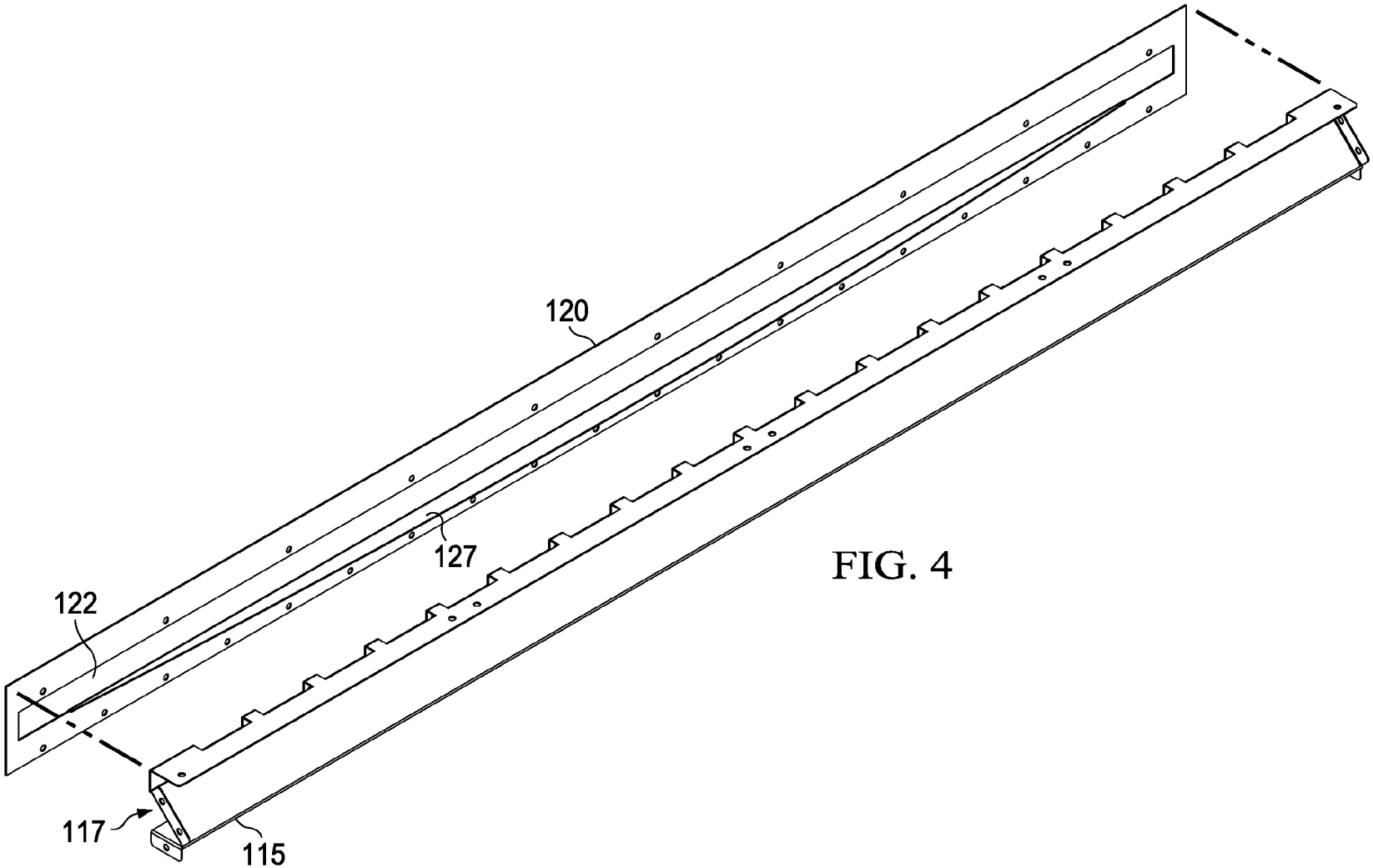
FIG. 4 presents a three-dimensional view of a dividing plate and fuel delivery plenum of the burner assembly, such as the example burner assembly depicted in FIGS. 1 and 2.

FIG. 4 presents a three-dimensional view of the fuel-delivery plenum 115 and the dividing plate 120 of the burner assembly of the disclosure, such as the example burner assembly 100 depicted in FIGS. 1 and 2. As illustrated in FIGS. 1 and 4, in some embodiments the dividing plate 120 includes a baffle 127. Certain embodiments of the baffle 127 can extend substantially along the long dimension 220 of the fuel metering plate 110. In some embodiments, the baffle 127 protrudes into the fuel chamber 117 of the fuel-delivery plenum 115. In these cases, the baffle 127 divides the fuel chamber 117 into upper and lower portions such that a fuel delivery rate to the upper portion of the fuel chamber 117 is altered along the long dimension 220. In some cases, as illustrated in FIG. 4, the baffle 127 has a crescent shape. A crescent-shaped baffle 127 can facilitate equalizing a rate of fuel delivery to the upper portion of the fuel chamber 117 along the long dimension 220 of the metering plate 110, thereby promoting the formation of a uniform flame along the long dimension 220.

Figure 5:
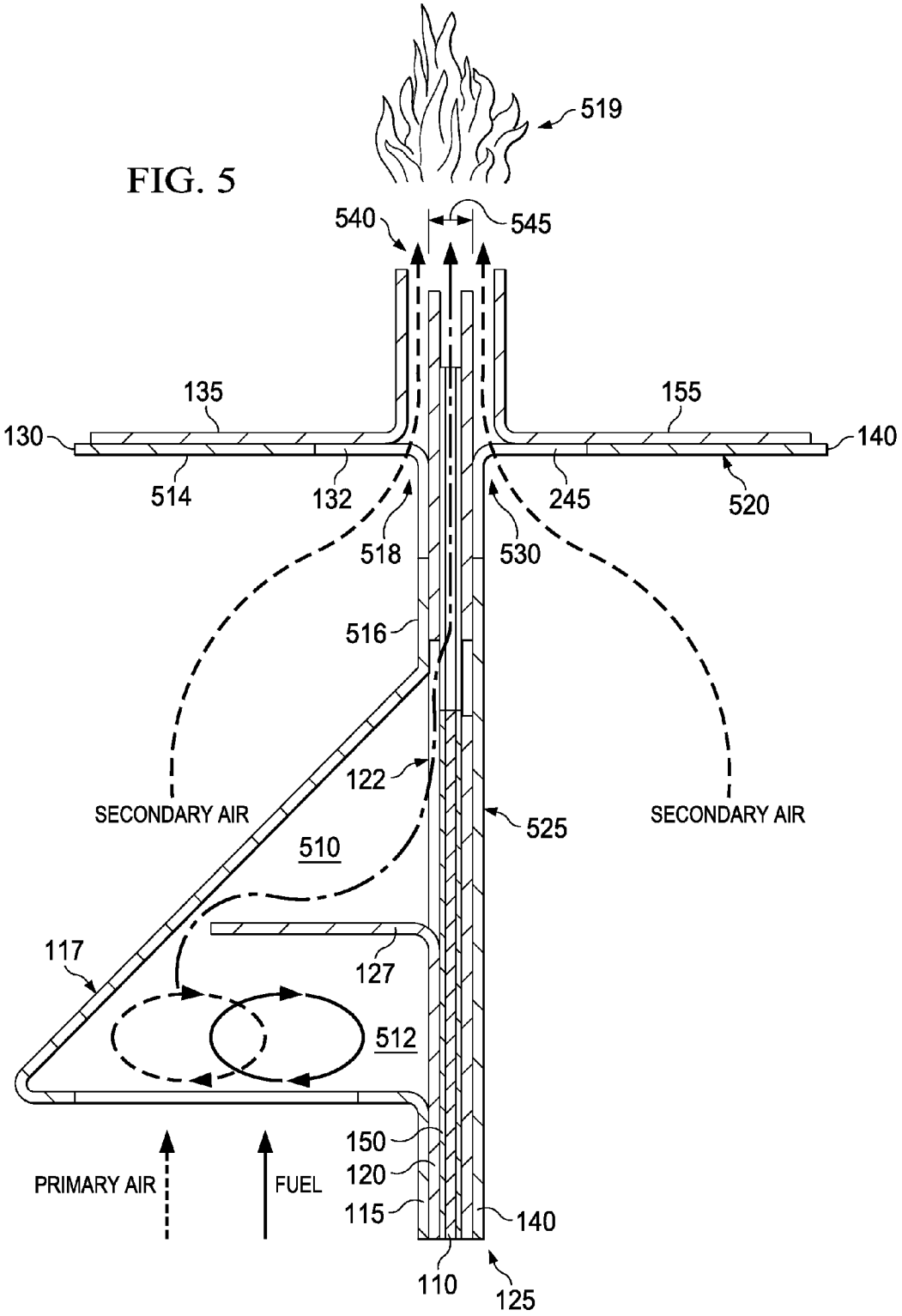
FIG. 5 presents a cross-sectional view of an example burner assembly of the disclosure such as the burner assembly depicted in FIG. 1 along view line 5-5.

This is further illustrated in FIG. 5, which presents a cross-sectional view of an example burner assembly of the disclosure such as a view of the burner assembly depicted 100 in FIG. 1 along view line 5-5. FIG. 5 illustrates an embodiment of the assembly 100 having a dividing plate 120 that includes a baffle 127 that protrudes into the chamber 117 of the fuel-delivery plenum 115, thereby forming upper and lower mixing chamber portions 510, 512 of the chamber 117.

In some embodiments, the fuel chamber 117 is formed of a fuel-delivery plenum 115 that is composed of a rigid material such as steel. In other cases, the fuel chamber 117 can be formed from a pliable material of the fuel-delivery plenum 115. Forming the fuel chamber 117 from a pliable material is advantageous in some embodiments where the stack 125 of the fuel-metering plate 110, fuel-delivery plenum 115, and the dividing plate 120 can include one or more bends, because the integrity of the fuel chamber 117 is more readily attained than if it is formed from a rigid material which is then subsequently bent.

Figure 6:
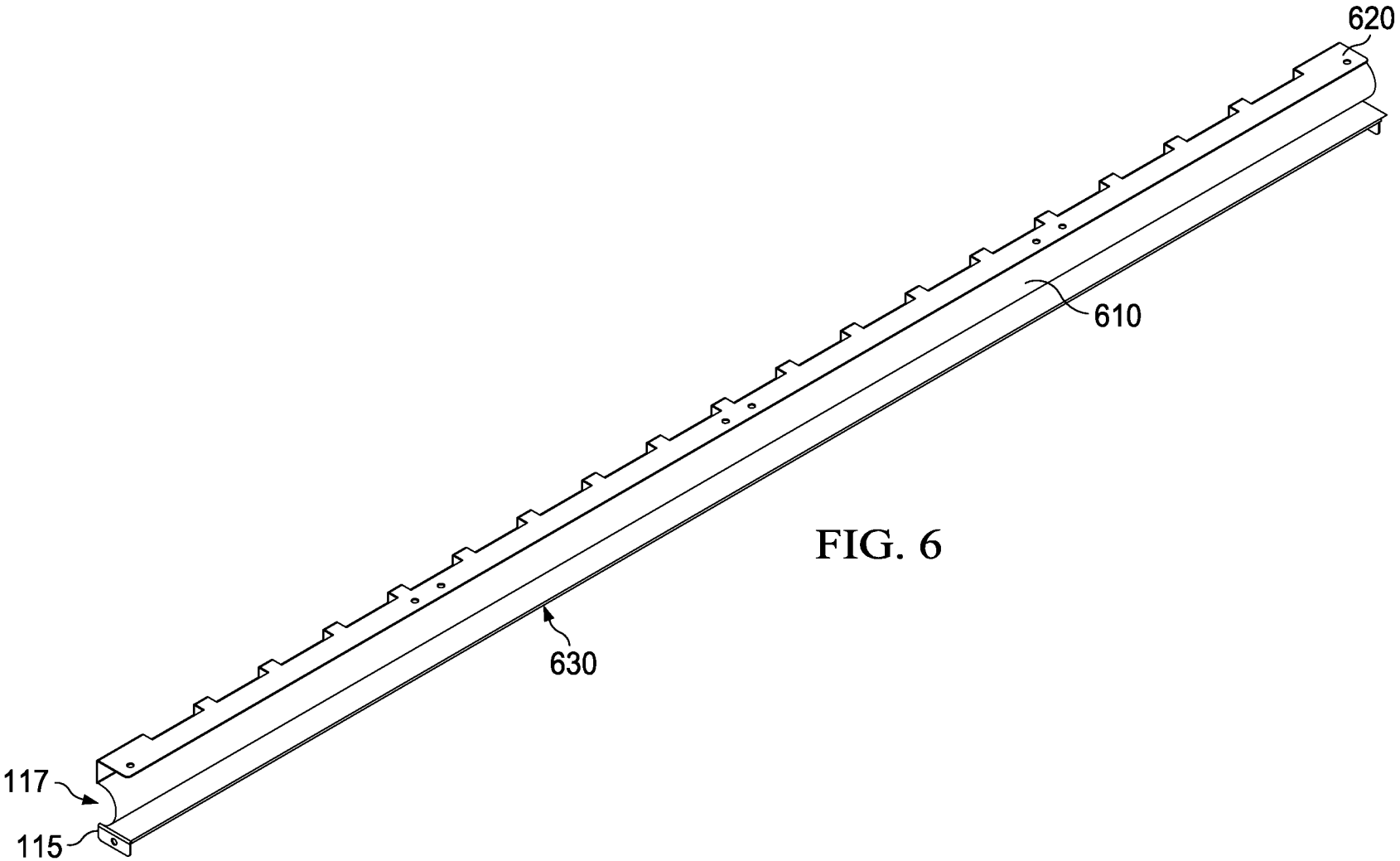
FIG. 6 presents a three-dimensional view of a fuel delivery plenum of the burner assembly, such as the example burner assembly depicted in FIGS. 1 and 2.

FIG. 6 presents a three-dimensional view of a fuel delivery plenum 115 of the burner assembly of the disclosure, such as the example burner assembly 100 depicted in FIGS. 1 and 2. In the illustrated embodiment, the plenum 115 includes a pliable bag 610 (e.g., a vinyl bag or other plastic or elastic deformable material shaped as a bag or other container) coupled to upper and lower mounting plates 620, 630 of the plenum 115 to thereby form the fuel chamber 117.

As further illustrated in FIGS. 1 and 2, in some embodiments, the assembly 100 further includes a secondary air delivery plate 130. The secondary air delivery plate 130 has one or more slotted openings 132 extending along the long dimension 220 of the fuel-metering plate 110. The slotted openings 132 allows mixing of secondary air (e.g., air from the atmosphere surrounding the assembly 100 traveling through the openings 132) with the fuel-primary air mixture exiting the channels 240. The secondary air delivery plate 130 by facilitating such secondary air mixing with the fuel-air mixture, to help further control the color, shape and intensity of the flame, and/or control the pressure drop in and above the assembly to control the velocity and the direction of the fuel-air mixture out of the burner assembly 100, to thereby adjust the height and visibility of the flame.

In some cases, the secondary air delivery plate 130 can be a separate component of the assembly 100 that is adjacent to the plenum 115 (e.g., located between the plenum 115 and dividing plate 120 in some case). In other cases, the secondary air delivery plate 130 can be integrated into another component of the assembly 100, such as the plenum 115 or the dividing plate 120. For instance, as illustrated in FIG. 2, the secondary air delivery plate 130 is integrated into the plenum 115. For instance, the secondary air delivery plate 130 can be composed of a same continuous material piece that forms the fuel-delivery plenum 115.

As also illustrated in FIG. 5, in some embodiments, portions of one or more slotted openings 132 can be located in a first wall 514 and in a second wall 516 of the secondary air delivery plate 130, the first wall 514 (e.g., a horizontal wall) and the second wall 516 (e.g., a vertical wall) converging to form a corner 518 (e.g., a right angled corner) that includes the one or more slotted openings 132 and the corner 518 is adjacent to the dividing plate 120. As illustrated, the secondary air flowing through the slotted openings 132 forces the fuel-air mixture (e.g., of primary air or fuel) in a more vertical direction, thereby influencing the direction and size of the flame 519 in a similar vertical direction thereby making the flame 519 taller, and hence, more visible.

As further illustrated in FIGS. 1, 2 and 5, in some cases, the assembly 100 can further include an air-metering plate 135 adjacent to the secondary air delivery plate 130 and configured to adjustably cover portions of the one or more slotted openings 132 (FIG. 2). For instance, in some cases, the air-metering plate 135 can be configured to rest on the first wall 514 (e.g., the horizontal wall) of the secondary air delivery plate 130 and to slide on the first wall 514 such that the slotted openings 132 are more or less covered. One skilled in the art would understand that the heat produced from combustion of the fuel causes a negative pressure which the secondary air traveling through the slotted openings 132 will experience. Adjusting the extent to which the slotted opening 132 are covered by the air-metering plate 135 permits fine tuning of the negative pressure experienced by the secondary air. In particular adjusting position of the air-metering plate 135 relative to the slotted openings 132 helps control the volume and/or velocity of secondary air flowing through the slotted openings 132 and mixing with the fuel exiting the channels 240 between the tines 205, thereby allowing further control of the height and visibility of the flame 519. Based on the present disclosure one skilled in the art would understand how to adjust size and the number of the slotted openings and the extent of coverage of the slotted openings 132 by the metering plate 135 to provide additional control and adjustment over flame height, shape, color and intensity.

As further illustrated in FIGS. 1, 2 and 5, in some embodiments the assembly 100 can have a second secondary air delivery plate 140. The second secondary air delivery plate 140 can have one or more slotted openings 245 similarly configured to that described for the slotted openings 132 of the secondary air delivery plate 130, although the number, size and distribution of the openings 245 does not have to be identical to the openings 132 of the first secondary air delivery plate 130. The one or more slotted openings 245 can be located in a first wall 520 and in a second wall 525 of the second secondary air delivery plate 140, the first wall 520 (e.g., a horizontal wall) and the second wall 525 (e.g., a vertical wall) converging to form a corner 530. The larger air flow afforded by having two secondary air delivery plates 130, 140 and their respective openings 132, 245 can facilitate additional control over flame height, shape, color and intensity.

In some embodiments as depicted in FIGS. 1-2 and 5, the secondary air delivery plate 130 and the second secondary air delivery plate 140 can be symmetrically positioned on either side of the fuel metering plate 110. The plates 130, 140 can be positioned such that the secondary air travelling through the one or more slotted openings 132, 245 mixes with the fuel exiting the channels 240 between the tines 205. As shown in FIG. 5, in some cases, the symmetrically positioned plates 130, 140 can help generate a symmetrical flow of secondary air mixing the fuel-primary air exiting the channels 240 to thereby produce a more symmetrically-shaped flame 335. In other cases, however, the secondary air delivery plates 130, 140 and their respective openings 132, 245 can be asymmetrically positioned about the fuel metering plate 110 to produce a flame with asymmetrical features.

As further illustrated in FIGS. 1-2 and 5, in some embodiments, where there is a second secondary air delivery plate 140, it can be advantageous for the assembly 100 to also include a second dividing plate 150. Analogous to the first dividing plate 120, the second dividing plate 150 can be located between the second secondary air delivery plate 140 and the fuel metering plate 110. The second dividing plate can be configured to cooperate with first dividing plate 120 to form a fuel-air mixing outlet trough 540 about the top of the tines 205 to provide additional control of height, shape, color and intensity of the flame 519 (FIG. 5), or, to adjust a width 545 of the outlet trough 540, and hence the flame's 519 width.

As further illustrated in FIGS. 1-2, in some embodiments where there is a second secondary air delivery plate 140, the assembly 100 can also include a second air metering plate 155. Analogous to the first air-metering plate 135, the second air-metering plate 155 can be located adjacent to the second secondary air delivery plate 140 and configured to adjustably cover portions of the second secondary air delivery plate's 140 one or more slotted openings 245.

Based on the disclosure one of ordinary skill would appreciate that there could be many other variations in the arrangement of the components of the assembly 100 to produce complex flames. For instance, in some embodiments of the assembly 100 there can be a plurality of pairs of metering plates 110 and dividing plates 120 arranged in a stacked assembly 125. The individual dividing plates 120 of the stacked assembly 125 can have differently sized or shaped openings 122, or the individual metering plates 110 can have different numbers or sizes or shapes of tines 205, to e.g., change the distribution of the primary fuel air mixture through the metering plate 110, and thereby alter the flame's characteristics (e.g., flame height, shape, color and intensity). Similarly, some embodiments can include stacked assemblies 125 that include the dividing plate 120, the secondary air delivery plate 120, the secondary air delivery plate 130, and/or air metering plates 135, to facilitate adjusting the flows of primary air to the metering plate or secondary air to the combustion region above the metering plate 110 and thereby change and customize the flame's characteristics.

Another embodiment of the disclosure is a fireplace that includes the burner assembly of the disclosure. Embodiments of the fireplace include indoor or outdoor fireplaces as well as outdoor fire pits in residential or commercial settings.

Figure 7:
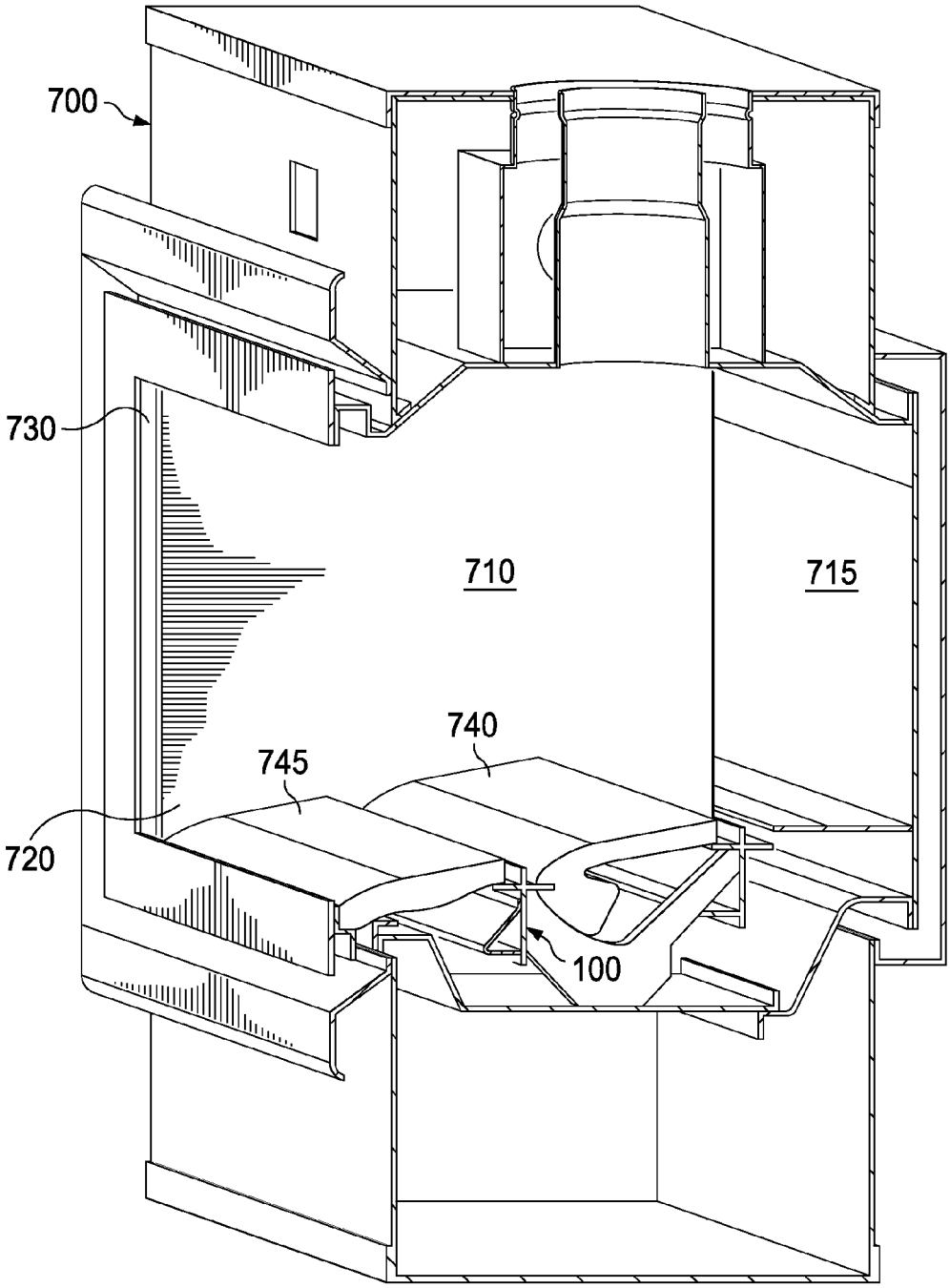
FIG. 7 presents a three-dimensional view of an example embodiment of the burner assembly located in an example fireplace of the disclosure.

FIG. 7 presents a cut-away perspective view of an example embodiment of selected portions of a fireplace 700 of the disclosure. The fireplace 700 comprises walls (e.g., side walls 710, rear wall 715) defining an enclosed space 720 and at least one opening 730. The fireplace 700 also comprises a burner assembly 100 located inside of the enclosed space 720, and, positioned such that a flame 519 (FIG. 5) emitted from the burner assembly 100, e.g., through cover plates 740, 745 is viewable through the opening 730 from outside of the fireplace 700.

The burner assembly 100 can include any of the embodiments discussed in the context of FIG. 1-5. For instance, the assembly 100 includes the fuel-metering plate 110, fuel delivery plenum 115 and dividing plate 120.

In some embodiments as shown in FIG. 7, the burner assembly 100 is configured such that the flame can be emitted substantially along the entire long dimension 220 of the fuel-metering plate 110 (FIG. 2), and, the burner assembly 100 is positioned in the enclosed space 720 such that the entire flame is viewable through the opening 730.

In some embodiments, different combinations of any of the individual plate structures discussed above in the context of FIGS. 1-5 can be merged into a single structure. For instance, in some cases, the baffle 127 can be incorporated into the metering plate 110.

Figure 8:
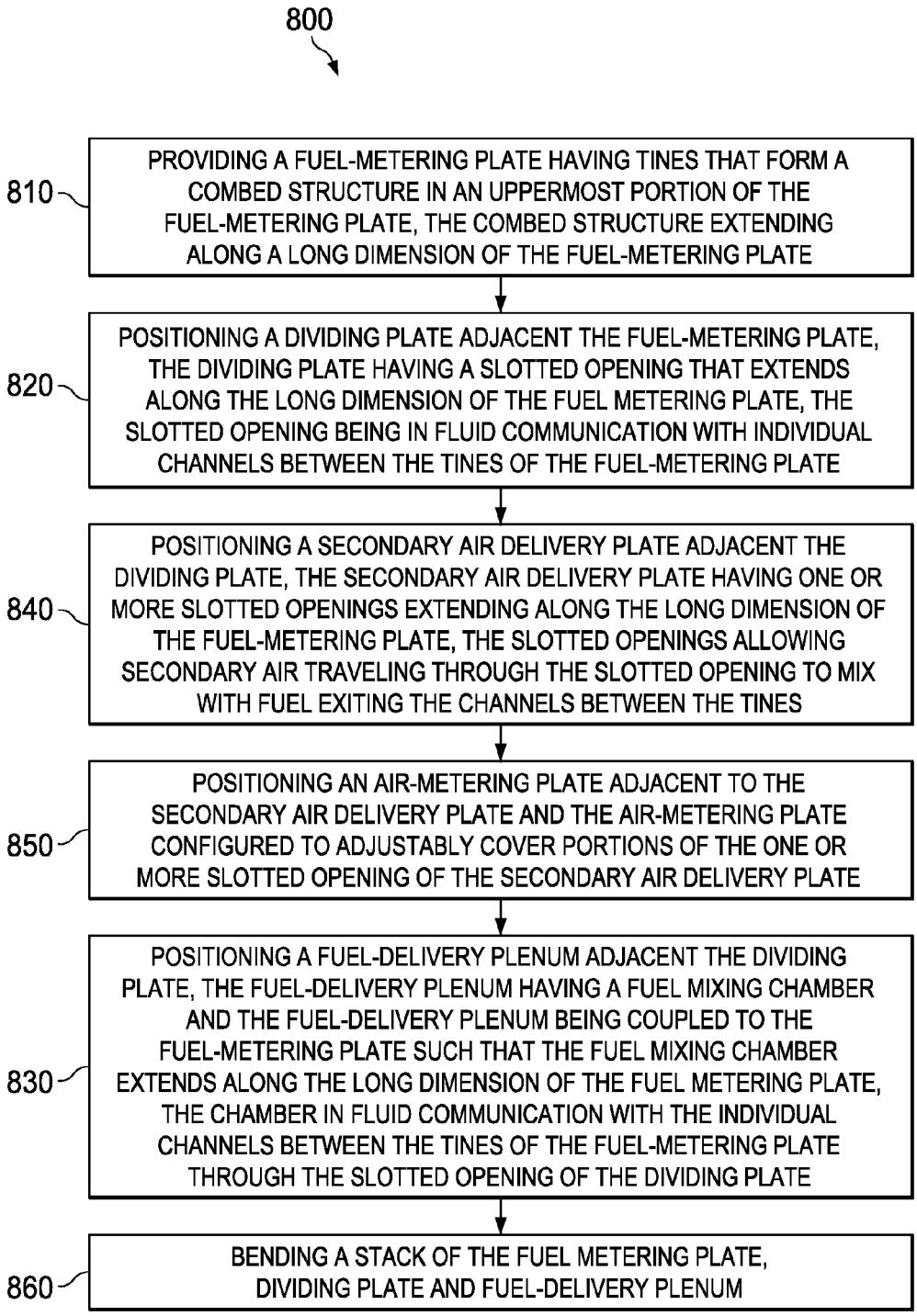
FIG. 8 presents a flow diagram of an example method of assembling a burner assembly of the disclosure, including any of the example embodiments discussed in the context of FIGS. 1-7.

Another embodiment of the present disclosure is a method of manufacturing a burner assembly, such as any of the assemblies 100 discussed in the context of FIGS. 1-5. FIG. 8 presents a flow diagram of an example method 800 of manufacture.

With continuing reference to FIGS. 1-5 throughout, the example method 800 comprises a step 810 of providing a fuel-metering plate 110 having tines 205 that form a combed structure 210 in an uppermost portion 215 of the fuel-metering plate 110, the combed structure 210 extending along a long dimension 220 of the fuel-metering plate 110.

The method 800 further comprises a step 820 of positioning a dividing plate 120 adjacent to the fuel-metering plate 110, the dividing plate 120 having a slotted opening 122 that extends along the long dimension 220 of the fuel metering plate 110, the slotted opening 122 being in fluid communication with individual channels 240 between the tines 205 of the fuel-metering plate 110.

The method 800 also comprises a step 830 of positioning a fuel-delivery plenum 115 adjacent to the dividing plate 120, the fuel-delivery plenum 115 having a fuel chamber 117 and the fuel-delivery plenum 115 being coupled to the fuel-metering plate 110 such that the fuel chamber 117 extends along the long dimension 220 of the fuel metering plate 110. As discussed in the context of FIG. 1, the fuel chamber 117 is in fluid communication with the individual channels 240 between the tines 205 of the fuel-metering plate 110 through the slotted opening 122 of the dividing plate 120.

Some embodiments of the method 800 can further include a step 840 of positioning a secondary air delivery plate 130 adjacent to the dividing plate 120, the secondary air delivery plate having one or more slotted openings 132 extending along the long dimension 220 of the fuel-metering plate. The slotted openings 132 allow mixing of secondary air with the fuel exiting the channels 240 between the times 205.

Some embodiments that include the step 840 of positioning the secondary air delivery plate 130 can also include a step 850 of positioning an air-metering plate 135 adjacent to the secondary air delivery plate 130. The air-metering plate 135 is configured to adjustably cover portions of the one or more slotted openings 132 of the secondary air delivery plate 130.

Some embodiments of the method 800 further include a step 860 of bending a stacked assembly 125 of the fuel metering plate 110, the dividing plate 120 and the fuel-delivery plenum 115 (or other optional plate components) such that the long dimension 220 of the fuel metering plate 110 is non-linear.

One of ordinary skill in the art would understand how to cut one or more sheets of material (e.g., a steel sheet) to form the features of the plate 110, such as the tines 205 and channels 240 between the tines 205. In some cases, for instance, providing the plate 110 can include laser cutting a steel sheet to form the metering plate 110. In other cases, the plate 110 could be formed by a process that includes mechanical stamping a material sheet, pouring a molten material into a mold, welding or otherwise coupling pieces of material together, or other fabrication well known to those skilled in the art. Similar procedures could be used to form the plenum 115, the dividing plate 120 or other components of the assembly 100.

Those skilled in the art to which this application relates will appreciate that other and further additions, deletions, substitutions and modifications may be made to the described embodiments.

The invention claimed is:

1. A burner assembly for a fireplace, comprising:

a fuel-metering plate having tines that form a combed structure in an uppermost portion of the fuel-metering plate, the combed structure extending along a long dimension of the fuel-metering plate;

a fuel-delivery plenum having a fuel chamber extending along the long dimension of the fuel metering plate; and a dividing plate locatable between the fuel-metering plate and the fuel-delivery plenum, the dividing plate having a slotted opening that extends along the long dimension of the fuel metering plate, the slotted opening being in fluid communication with individual channels between the tines and with the fuel chamber, wherein two separated surfaces of the fuel delivery plenum opposing the fuel metering plate are coupleable to the fuel metering plate to enclose the fuel chamber between the two separated surfaces and the dividing plate.

2. The assembly of claim 1, wherein the long dimension forms a straight line.

3. The assembly of claim 1, wherein all of the tines have a same width, a same height, and, adjacent tines are equally spaced apart by a same distance.

4. The assembly of claim 1, wherein the tops of the tines are all in a same horizontal plane.

5. A burner assembly for a fireplace, comprising:

a fuel-metering plate having tines that form a combed structure in an uppermost portion of the fuel-metering plate, the combed structure extending along a long dimension of the fuel-metering plate;

a fuel-delivery plenum having a fuel chamber and the fuel-delivery plenum being coupleable to the fuel-metering plate such that the fuel chamber extends along the long dimension of the fuel metering plate when the fuel-metering plate and the fuel delivery plenum are coupled together; and a dividing plate locatable between the fuel-metering plate and the fuel-delivery plenum, the dividing plate having a slotted opening extending along the long dimension of the fuel metering plate, the slotted opening being in fluid communication with individual channels between the tines and with the fuel chamber when the dividing plate is between the fuel-metering plate and the fuel delivery plenum, wherein the dividing plate further includes a baffle extending along the long dimension and dividing the fuel chamber into upper and lower portions such that a rate of fuel delivery to the upper portion of the fuel chamber is altered along the long dimension.

6. The assembly of claim 1, wherein the fuel chamber is formed of a pliable material of the fuel-delivery plenum.

7. A burner assembly for a fireplace, comprising:

a fuel-metering plate having tines that form a combed structure in an uppermost portion of the fuel-metering plate, the combed structure extending along a long dimension of the fuel-metering plate;

a fuel-delivery plenum having a fuel chamber and the fuel-delivery plenum being coupleable to the fuel-metering plate such that the fuel chamber extends along the long dimension of the fuel metering plate when the fuel-metering plate and the fuel delivery plenum are coupled together;

a dividing plate locatable between the fuel-metering plate and the fuel-delivery plenum, the dividing plate having a slotted opening extending along the long dimension of the fuel metering plate, the slotted opening being in fluid communication with individual channels between the tines and with the fuel chamber when the dividing plate is between the fuel-metering plate and the fuel delivery plenum; and a secondary air delivery plate, the secondary air delivery plate having one or more slotted openings extending along the long dimension of the fuel-metering plate and allowing mixing of secondary air with fuel exiting the channels between the tines.

8. The assembly of claim 7, where the secondary air delivery plate is a same continuous material piece that forms the fuel-delivery plenum.

9. The assembly of claim 7, wherein portions of the one or more slotted openings are in a first wall and in a second wall of the secondary air delivery plate, the first wall and the second wall converging to form a corner that includes the one or more slotted openings and the corner being adjacent to the dividing plate.

10. The assembly of claim 7, further including an air-metering plate located adjacent to the secondary air delivery plate and configured to adjustably cover portions of the one or more slotted openings.

11. The assembly of claim 7, further including a second secondary air delivery plate, the secondary air delivery plate and the second secondary air delivery plate being symmetrically positioned on either side of the fuel metering plate such that the one or more slotted openings of both the secondary air delivery plate and the second secondary air delivery plate allow mixing of secondary air with fuel exiting the individual channels between the tines.

12. The assembly of claim 11, further including a second dividing plate located between the second secondary air delivery plate and the fuel metering plate.

13. The assembly of claim 1, wherein the fuel-metering plate is one of a plurality of fuel-metering plates arranged in a stacked fuel metering assembly.

14. The assembly of claim 13, wherein the dividing plate and the metering plate are one pair of a plurality of pairs of dividing plates and metering plates arranged in a stacked assembly.

15. A fireplace, comprising:

walls defining an enclosed space and at least one opening; and a burner assembly located inside of the enclosed space and positioned such that a flame emitted from the burner assembly is viewable through the opening from outside of the fireplace, the burner assembly including:

a fuel-metering plate having tines that form a combed structure in an uppermost portion of the fuel-metering plate, the combed structure extending along a long dimension of the fuel-metering plate;

a fuel-delivery plenum having a fuel chamber extending along the long dimension of the fuel metering plate; and a dividing plate locatable between the fuel-metering plate and the fuel-delivery plenum, the dividing plate having a slotted opening that extends along the long dimension of the fuel metering plate, the slotted opening being in fluid communication with individual channels between the tines and with the fuel chamber, wherein two separated surfaces of the fuel delivery plenum opposing the fuel metering plate are coupleable to the fuel metering plate to enclose the fuel chamber between the two separated surfaces and the dividing plate.

16. The fireplace of claim 15, wherein the burner assembly is configured such that the flame is emitted substantially along the entire long dimension of the fuel-metering plate, and, the burner assembly is positioned in the enclosed space such that the entire flame is viewable through the opening from outside of the fireplace.

17. A method of manufacturing a burner assembly, comprising:

forming a fuel-metering plate having tines that form a combed structure in an uppermost portion of the fuel-metering plate, the combed structure extending along a long dimension of the fuel-metering plate;

forming a dividing plate, the dividing plate having a slotted opening;

forming a fuel-delivery plenum adjacent to the dividing plate, the fuel-delivery plenum having a fuel chamber wherein the dividing plate is positionable adjacent to the fuel-metering plate such that the slotted opening extends along the long dimension of the fuel metering plate, the slotted opening being in fluid communication with individual channels between the tines of the fuel-metering plate; and two separated surfaces of the fuel delivery plenum opposing the fuel metering plate are coupleable to the fuel metering plate to enclose the fuel chamber between the two separated surfaces and the dividing plate such that the fuel chamber extends along the long dimension of the fuel metering plate, the fuel chamber being in fluid communication with the individual channels between the tines of the fuel-metering plate through the slotted opening of the dividing plate.

18. The method of claim 17, further including positioning a secondary air delivery plate adjacent to the dividing plate, the secondary air delivery plate having one or more slotted openings extending along the long dimension of the fuel-metering plate and allowing mixing of secondary air traveling through the slotted openings with fuel exiting the channels between the times.

19. The method of claim 18, further including positioning an air-metering plate adjacent to the secondary air delivery plate and the air-metering plate configured to adjustably cover portions of the one or more slotted openings of the secondary air delivery plate.

20. The method of claim 17, further including bending a stack of the fuel metering plate, the dividing plate and the fuel-delivery plenum, such that the long dimension of the fuel metering plate is non-linear.

21. A fireplace, comprising:

walls defining an enclosed space and at least one opening; and a burner assembly located inside of the enclosed space and positioned such that a flame emitted from the burner assembly is viewable through the opening from outside of the fireplace, the burner assembly including:

a fuel-metering plate having tines that form a combed structure in an uppermost portion of the fuel-metering plate, the combed structure extending along a long dimension of the fuel-metering plate;

a fuel-delivery plenum having a fuel chamber and the fuel-delivery plenum being coupleable to the fuel-metering plate such that the fuel chamber extends along the long dimension of the fuel metering plate when the fuel-metering plate and the fuel delivery plenum are coupled together; and a dividing plate locatable between the fuel-metering plate and the fuel-delivery plenum, the dividing plate having a slotted opening extending along the long dimension of the fuel metering plate, the slotted opening being in fluid communication with individual channels between the tines and with the fuel chamber when the dividing plate is between the fuel-metering plate and the fuel delivery plenum, wherein the dividing plate further includes a baffle extending along the long dimension and dividing the fuel chamber into upper and lower portions such that a rate of fuel delivery to the upper portion of the fuel chamber is altered along the long dimension.

22. A fireplace, comprising:

walls defining an enclosed space and at least one opening; and a burner assembly located inside of the enclosed space and positioned such that a flame emitted from the burner assembly is viewable through the opening from outside of the fireplace, the burner assembly including:

a fuel-metering plate having tines that form a combed structure in an uppermost portion of the fuel-metering plate, the combed structure extending along a long dimension of the fuel-metering plate;

a fuel-delivery plenum having a fuel chamber and the fuel-delivery plenum being coupleable to the fuel-metering plate such that the fuel chamber extends along the long dimension of the fuel metering plate when the fuel-metering plate and the fuel delivery plenum are coupled together;

a dividing plate locatable between the fuel-metering plate and the fuel-delivery plenum, the dividing plate having a slotted opening extending along the long dimension of the fuel metering plate, the slotted opening being in fluid communication with individual channels between the tines and with the fuel chamber when the dividing plate is between the fuel-metering plate and the fuel delivery plenum; and a secondary air delivery plate, the secondary air delivery plate having one or more slotted openings extending along the long dimension of the fuel-metering plate and allowing mixing of secondary air with fuel exiting the channels between the tines.

* * * * *